United States Patent [19]

Winer

[11] Patent Number: 4,665,562

[45] Date of Patent: May 19, 1987

[54] LEG PROTECTING APPARATUS

[76] Inventor: Grace S. Winer, Box 876, Bozeman, Mont. 59715

[21] Appl. No.: 915,701

[22] Filed: Oct. 6, 1986

[51] Int. Cl.[4] ..... A41D 13/06; A41D 27/12

[52] U.S. Cl. ..... 2/22; 2/46; 2/59; 2/DIG. 6; 36/2 R

[58] Field of Search ..... 2/22, 2 R, 46, 59, 61, 2/62, DIG. 6; 36/1.5, 2 R, 70 R

[56] References Cited

U.S. PATENT DOCUMENTS

| | | | |
|---|---|---|---|
| 1,158,208 | 10/1915 | Hart | 2/22 |
| 1,678,566 | 7/1928 | Gallant | 36/2 R |
| 2,128,159 | 8/1938 | Morgan | 2/62 |
| 2,434,064 | 1/1948 | Bredin | 36/2 R X |
| 2,607,920 | 8/1952 | Lawrence | 2/62 |
| 3,083,373 | 4/1963 | Rizzotto | 36/2 R X |
| 4,036,220 | 7/1977 | Ballasalma | 2/59 X |

*Primary Examiner*—H. Hampton Hunter
*Attorney, Agent, or Firm*—Arthur L. Urban

[57] ABSTRACT

Leg protecting apparatus includes a calf cover portion and a cover supporting portion. The calf cover portion includes a main section having a generally rectangular configuration with shorter upper and lower edges and longer side edges. An ankle covering section extends downwardly from the lower edge of the main section. The main section and the ankle covering section are formed from a woven fabric material, the fabric material being a tightly woven flexible moisture and grease resistant smooth flat fabric. The cover supporting portion includes a pair of spaced elongated strap members, the strap members being disposed substantially parallel to one another and substantially perpendicular to a longitudinal centerline of the main section. The strap members are formed of moisture and grease resistant flat woven material. The strap members are of different lengths, the longer of the strap members being secured to the main section along the upper edge thereof with free ends extending substantially equal lengths beyond each side edge of the main section. The shorter of the strap members is secured to the lower edge of the main section adjacent the juncture thereof with the ankle covering section, free ends of the shorter strap member extending substantially equal lengths beyond each side edge of the main section. The free ends of each strap member include cooperating pairs of engageable hooked and napped fabric fastener sections.

12 Claims, 4 Drawing Figures

LEG PROTECTING APPARATUS

This invention relates to a novel protecting apparatus and more particularly relates to a new apparatus for protecting the leg of a bicycle rider.

The first bicycles were powered through pedals mounted directly on the front wheel. Later bicycle designs utilize pedals mounted on a sprocket located under the rider with an endless chain connecting the pedal sprocket and a second sprocket mounted on the rear wheel.

Although this design is the accepted standard even today because of the advantages that it affords both for single speed and multi-speed drive trains, the design is not without its shortcomings. One is that the chain passes closely to the calf of the rider as his right leg applies pressure to the pedal causing the sprocket to rotate.

It is customary to lubricate the chain with grease to reduce friction and wear. This grease can rub off onto the rider's leg or a leg covering if the leg should accidentally shift into the path of the chain as the leg moves with the pedals. This contact causes the grease to transfer to the rider's leg or to leg clothing. Not only does grease rub off, but also any dirt or other contaminants adhering to grease will be transferred onto the rider's clothing or leg.

Through the years, various expedients have been proposed and used in an attempt to alleviate soiling problems caused by bike chains as well as the problem of catching a pant leg in the chain. One solution was the use of chain guard. This device utilized a metal cover that extended along the top of the chain and down the front of the sprocket, the area closest to the rider's leg. The chain guard was of limited use since it easily was displaced into contact with the chain so it would scrape against the guard causing an irritating sound as a rider pedaled a bike.

Another solution involved the use of a so-called "bicycle clip". This device was a strip of spring steel bent into a configuration approximating the circumferential shape of the rider's leg. The trouser leg was carefully wrapped around the leg and the clip positioned over the pant leg to hold it tightly against the leg and away from the chain and sprocket. The bicycle clip took time to position and if the rider forgot to remove it could cause embarrassment. In addition, the clip was easily misplaced so that it would be available when needed.

Some individuals who found the chain guard and clip to be unsatisfactory developed their own makeshift solutions such as rubber bands or wrapping strips to hold the pant leg away from the chain. However, these expedients also were not popular since they required that the user devote time and attention to positioning the device so the pant leg would be held tightly against the leg thus providing maximum separation from the chain and sprocket.

In recent years with the increase in popularity of multi-speed bikes, the problem of catching a trouser leg between the chain and sprocket has been substantially eliminated through the adoption of a sprocket with a protective disc member of a size larger than the largest sprocket disposed on the side of the sprocket closest to the rider's leg. With this construction, a pant leg is maintained spaced from sprocket/chain engagement by the enlarged disc member. However, even in this improvement, contact with the free lengths of the chain with a rider's leg still occurs frequently.

From the above discussion, it is clear that previous devices and procedures that attempt to keep bike rider's legs and pants clean have not been completely satisfactory under normal bicycling conditions. Therefore, there is a need for a new leg protecting apparatus that overcomes the deficiencies of earlier and current expedients.

The present invention provides a novel leg protecting apparatus which not only overcomes the shortcomings of previous devices and methods but also provides features and advantages not found in such devices. The leg protecting apparatus of the invention keeps a bicycle rider's leg or pant leg free from contact with a bicycle chain. The apparatus insures that the rider's leg or pants will be clean after the ride is completed. This is becoming important as more people adopt bicyles for transportation to work or classes rather than simply for recreation. Thus, a rider using the apparatus avoids the possibility of being embarrassed because of a soiled leg or garment. As a result, the leg protecting apparatus also reduces commercial cleaning expenses.

The leg protecting apparatus of the present invention is simple in design and relatively inexpensive. The apparatus can be fabricated from commercially available materials and components. Conventional manufacturing techniques and procedures and semi-skilled labor can be employed in the production of the apparatus.

The leg protecting apparatus of the invention can be used efficiently by persons with limited aptitude and dexterity after a minimum of instruction. The apparatus is attractive in appearance and is comfortable to wear.

The apparatus fits all ages and genders. Only a few sizes accommodate users with widely varying measurements. The apparatus can be adjusted easily and quickly to provide a snug fit on differing leg sizes and shapes and also to accommodate various thicknesses of leg coverings.

The leg protecting apparatus of the invention can be removed by a rider quickly and folded into a compact package that conveniently fits into a pocket, purse or briefcase. The apparatus can be cleaned simply by wiping with a dry cloth or a wet cloth with or without a detergent or other cleaning agent.

These and other benefits and advantages of the novel leg protecting apparatus of the present invention will be apparent from the following description and the accompanying drawings in which.

Figure 1:
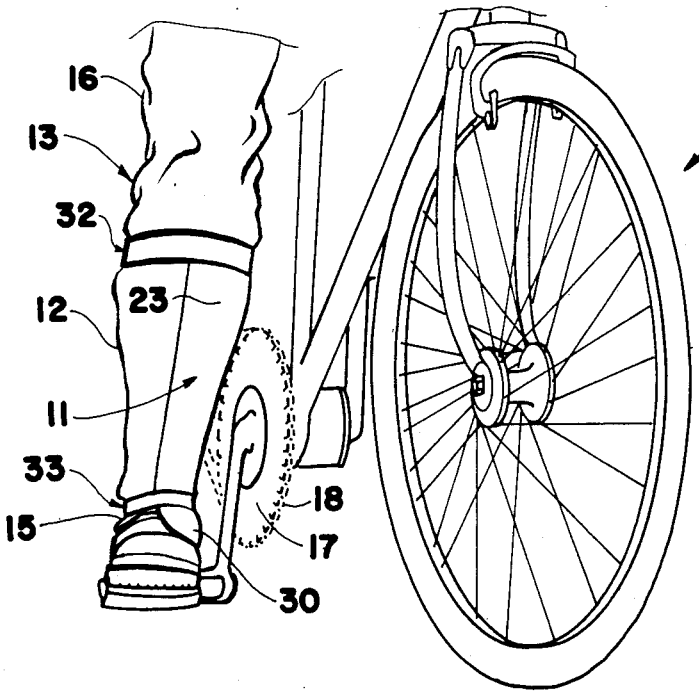
FIG. 1 is a view in perspective of one form of the leg protecting apparatus of the invention positioned on the inside of the right leg of a bicycle rider.

As shown in the drawings, one form of the novel leg protecting apparatus 11 of the present invention is positioned on the inside of the right calf 12 of leg 13 of a rider of bicycle 14. The apparatus 11 protects calf 12 and ankle 15 or clothing 16 covering same from being soiled or injured from sprocket 17 and/or chain 18 being advanced thereon.

The leg protecting apparatus 11 of the present invention includes a calf cover portion 21 and a cover supporting portion 22. The calf cover portion 21 includes a main section 23 having a generally rectangular configuration. The main section has shorter upper and lower edges 24 and 25, respectively, with longer side edges 26 and 27.

The calf cover portion 21 also includes an ankle covering section 30 which extends downwardly from the lower edge 25 of the main section 23. The ankle covering section 30 has a generally arcuate configuration with a width substantially the same as the width of the main section. The ankle covering section advantageously has a semi-circular configuration. Preferably, the ankle covering section 30 and the main section 23 are formed as a unitary structure.

The main section 23 and the ankle covering section 30 are formed of a woven fabric material. The fabric material is a tightly woven flexible moisture and grease resistant smooth flat fabric. Suitable fabrics include those employed in the fabrication of back packs and similar products sometimes referred to as "pack cloth". Advantageously, the fabric is a nylon fabric. The calf cover portion 21 preferably includes a plurality of fabric layers. The moisture and grease resistance may be achieved by treating the fabric with known chemicals or may be inherent characteristics of the fabric structure.

The calf cover portion 21 advantageously has a length between about ten and sixteen inches. Preferably, the width of the calf cover portion is approximately onehalf the length thereof. The cover supporting portion 22 of the leg protecting apparatus 11 of the present invention includes a pair of spaced elongated strap members 32 and 33. The strap members are formed of moisture and grease resistant flat woven material which advantageously is woven nylong webbing.

The spaced strap members 32 and 33 are disposed substantially parallel to one another and substantially perpendicular to a longitudinal centerline of the main section. The strap members preferably are stitched to the calf cover portion 21.

The strap members 32 and 33 are of different lengths. The longer strap member 32 is secured to the main section 23 along the upper edge 24 thereof. The strap member 32 is oriented with respect to the main section so free ends 34 and 35 thereof extend substantially equal lengths beyond each side edge 26 and 27 of the main section.

The shorter strap member 33 of the pair is secured to the lower edge 25 of the main section adjacent to the juncture of the main section with the ankle covering section 30. The shorter strap member 33 also is oriented with respect to the main section so free ends 37 and 38 thereof extend substantially equal lengths beyond each side edge of the main section.

The longer strap member 32 advantageously has a length approximately one and one-half times the length of the calf cover portion 21. The shorter strap member 33 preferably has a length approximately the same as the length of the calf cover portion or most preferably sligthly longer.

The free ends 34 and 35 of strap 32 and the free ends 37 and 38 of strap 33 include cooperating pairs of engageable fabric fastener sections 40, 41 and 42, 43 respectively. One of each pair includes an elongated hooked fabric section and the other of each pair includes an elongated napped fabric section.

One fastener section of each pair is disposed on a front face of one free end of a strap member and the other fastener section of each pair is disposed on a reverse face of the other free end of the same strap member. The hooked and napped fabric sections have widths approximating the width of the strap members 32 and 33.

Figure 2:
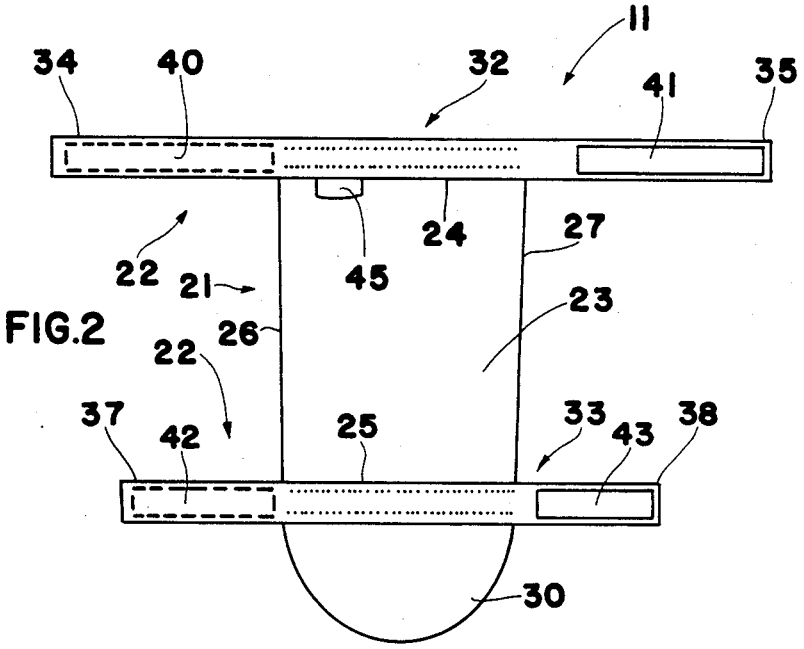
FIG. 2 is a front view of the leg protecting apparatus shown in FIG. 1 in a flat configuration.

Advantageously, each of the free ends 35 and 38 of the straps that extend to the right of the calf cover portion 21 includes an elongated fabric fastener section 41 or 43 on the front face thereof as shown in FIG. 2. The cooperating fastener section is disposed on the reverse face of the left free end. Thus, the cooperating pair of fabric fastener sections will engage one another when the free ends of the same strap overlap as the apparatus is secured over the calf of the bicycle rider.

For example, as shown in FIG. 2 of the drawings, strap member 32 has a free end 35 that extends to the right of the main section 23 with a fastener section 41 disposed on the front face thereof. Similarly, free end 34 that extends to the left of the main section has a fastener section 40 disposed on the reverse face or back thereof. When the strap 32 is wrapped around a leg calf, fastener section 40 will overlap and engage fastener section 41.

The same situation occurs when strap 33 is wrapped around the rider's calf. Fastener section 42 on the reverse side of free left end 37 overlaps and engages the fastener section 43 on the front face of the free right end 38. Since the fastener sections are elongated along the length of the free ends, the overlap of the straps can be adjusted to provide a snug fit of the leg protecting apparatus on the rider's calf and still be comfortable.

The leg protecting apparatus 11 of the present invention is fabricated by cutting fabric in a configuration to form the main section 23 and the ankle covering section 30, advantageously, as a single piece with a number of pieces being combined into a plurality of layers. The free edges preferably are secured such as by stitching and hidden by turning the assembly inside out so the stitching is on the inside. If desired, a decorative and/or instructional label 45 may be included.

Then, the strap members 32 and 33 are stitched to the assembly in the spatial orientation shown in the drawings. Thereafter, the fabric fastener sections 40–43 are affixed to the free ends of the strap members. The leg protecting apparatus now is ready for use.

To use the leg protecting apparatus 11 of the invention, the calf cover portion 21 is positioned over the inside of the right calf 12 of the rider. The rider grasps the ends of the strap member 32 and wraps them around the calf so they overlap on the opposite side of the leg. The fabric fastener sections 40 and 41 are pressed together, securing the upper end of the apparatus to the leg.

In the same way, the free ends of strap member 33 are wrapped around the leg adjacent the ankle and the overlapping fabric fastener sections 42 and 43 are pressed together. The two strap members 32 and 33 hold the apparatus snugly but comfortably on the leg with the ankle contacting section 30 over the inner ankle bone of the rider as shown in FIG. 1.

In this position, the apparatus 11 of the present invention protects the rider's leg and particularly the calf against accidental contact with the sprocket 17 and/or chain 18 and the transfer of grease and other contaminants. Thus, a rider can be sure that clothing or a bare leg is not soiled which may require immediate attention to remove the soil or the risk of embarrassment by its continuing presence.

When the bicycle rider reaches the destination, the leg protecting apparatus 11 is removed from the leg by separating the fastener sections 40 and 41 as well as sections 42 and 43. This action frees the apparatus from the leg.

Since the leg protecting apparatus of the invention is moisture and grease resistant, it ordinarily does not soil as readily as a rider's garments. However, when the apparatus finally does become soiled, it can be cleaned easily and simply by laundering or by wiping with a dry or wet cloth with or without a detergent. The apparatus dries quickly and can be used again after a short interval.

Figure 3:
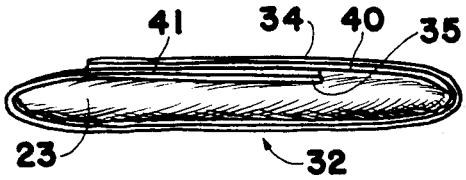
FIG. 3 is a side view of the leg protecting apparatus shown in FIGS. 1 and 2 in a folded configuration for storage.
Figure 4:
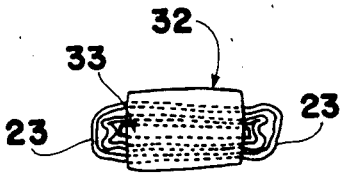
FIG. 4 is an end view of the folded leg protecting apparatus shown in FIG. 3.

For convenient storage, the leg protecting apparatus can be folded into a compact package to be slipped into a pocket, purse or briefcase. This can be accomplished by folding section 30 onto main section 23 and folding the ends 37 and 38 of strap 33 over the main section. The combination of main section 30 and strap 33 then is folded toward and onto the center part of strap 32. When the folding is completed, the free ends 34 and 35 of the strap 32 overlap and the fastener sections 40 and 41 are pressed together. In this way, a compact package is formed that is of a size in one dimension approximately the width of the main section and in the other dimension approximates the width of the strap members as shown in FIGS. 3 and 4.

The above description and the accompanying drawings show that the present invention provides a novel leg protecting apparatus which overcomes the shortcomings of previous devices and methods. Also, the apparatus of the invention provides features and advantages not found in earlier devices.

The leg protecting apparatus 11 of the invention keeps clean a bicycle rider's leg or pants covering same. Contaminants from the chain and sprocket cannot reach the rider's leg. Thus, a rider does not have to worry about having to clean a leg or garment immediately at the end of a ride of alternatively be embarrassed at having to attend a public function with soiled clothing. This is especially important for individuals using bikes for transportation rather than recreation.

The leg protecting apparatus of the invention is simple in design and can be fabricated from commercially available materials and components relatively inexpensively. The apparatus is durable in construction and has a long useful life without maintenance other than periodic cleaning.

The apparatus accommodates a range of leg sizes and can be positioned and removed easily and quickly. The apparatus is attractive in appearance and is comfortable to wear. It can be stored conveniently in a small package.

It will be apparent that various modifications can be made in the particular leg protecting apparatus described in detail above and shown in the draiwngs within the scope of the present invention. The size, configuration and arrangement of components can be changed to meet specific requirements. The fabric from which the main and ankle covering sections are formed can be patterned or decorated or a logo applied if desired. Other types of fasteners can be employed. These and other changes can be made in the leg protecting apparatus described above provided the functioning and operation thereof are not adversely affected. Therefore, the scope of the present invention is to be limited only by the following claims.

What is claimed is:

1. Leg protecting apparatus including a calf cover portion and a cover supporting portion; said calf cover portion including a main section having a generally rectangular configuration with shorter upper and lower edges and longer side edges, an ankle covering section extending downwardly from said lower edge of said main section, said ankle covering section having a generally arcuate configuration with a width substantially the same as the width of said main section, said main section and said ankle covering section being formed from a woven fabric material, said fabric material being a tightly woven flexible moisture and grease resistant smooth flat fabric; said cover supporting portion including a pair of spaced elongated strap members, said strap members being disposed substantially parallel to one another and substantially perpendicular to a longitudinal centerline of said main section, said strap members being formed of moisture and grease resistant flat woven material, said strap members being of different lengths, the longer of said strap members being secured to said main section along said upper edge thereof with free ends extending substantially equal lengths beyond each side edge of said main section, the shorter of said strap members being secured to said lower edge of said main section adjacent the juncture thereof with said ankle covering section, free ends of said shorter strap member extending substantially equal lengths beyond each side edge of said main section, said free ends of each strap member including cooperating pairs of engageable fabric fastener sections, one of each pair including an elongated hooked fabric section and the other of each pair including an elongated napped fabric section, one section of each pair being disposed on a front face of one free end of a strap member and the other of the said pair being disposed on a reverse face of the other free end of the same strap member, said hooked and napped fabric fastener sections having widths approximating the width of said strap members; whereby said leg protecting apparatus can be carried in a small folded configuration of a size approximating in one dimension the width of said main section and in the other dimension the width of said strap members, unfolded into an open flat configuration, wrapped around the right leg of a bicylce rider with said main section against the inside of the calf and said ankle covering section extending over the ankle of the rider, the free ends of the strap members extended around the calf and secured to one another in an overlapping relationship by engaging said cooperating hooked and napped fabric fastener sections and thereby protect the calf of the rider when pedaling a bicycle.

2. Leg protecting apparatus according to claim 1 wherein said main section and said ankle covering section are formed as a unitary structure.

3. Leg protecting apparatus according to claim 1 wherein said calf cover portion includes a nylon fabric.

4. Leg protecting apparatus according to claim 1 wherein said calf cover portion includes a plurality of fabric layers.

5. Leg protecting apparatus according to claim 1 wherein said calf cover portion has a length between about ten and sixteen inches.

6. Leg protecting apparatus according to claim 1 wherein said calf cover portion has a width approximately one-half the length thereof.

7. Leg protecting apparatus according to claim 1 wherein said ankle covering section has a semi-circular configuration.

8. Leg protecting apparatus according to claim 1 wherein said strap members are formed of woven nylon webbing.

9. Leg protecting apparatus according to claim 1 wherein said strap members are stitched to said calf cover portion.

10. Leg protecting apparatus according to claim 1 wherein the longer of said strap members has a length approximately one and one-half times the length of said calf cover portion.

11. Leg protecting apparatus according to claim 1 wherein the shorter of said strap members has a length approximately the same as the length of said calf cover portion.

12. Leg protecting apparatus according to claim 1 wherein each of said free ends of said strap members extending to the right of said calf cover portion includes an elongated fabric fastener section on the front face thereof.

* * * * *